US006563480B1

(12) United States Patent
Nakamura

(10) Patent No.: US 6,563,480 B1
(45) Date of Patent: May 13, 2003

(54) LED DISPLAY PANEL HAVING A MEMORY CELL FOR EACH PIXEL ELEMENT

(75) Inventor: Akira Nakamura, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/175,771

(22) Filed: Oct. 20, 1998

(30) Foreign Application Priority Data

Oct. 20, 1997 (JP) ..... 9-287284

(51) Int. Cl.[7] ..... G09G 3/32

(52) U.S. Cl. ..... 345/82; 345/97; 345/90; 345/98; 345/205; 345/206; 345/505; 340/825.81; 340/825.82; 315/169.1; 315/169.2; 315/169.3

(58) Field of Search ..... 345/90, 87, 98, 345/205, 82, 206, 505; 340/825.82, 825.81; 315/169.2, 169.3, 169.1

(56) References Cited

U.S. PATENT DOCUMENTS 5,264,948 A * 11/1993 Imoto ..... 358/474
5,280,280 A * 1/1994 Hotto ..... 345/94
5,339,090 A * 8/1994 Crossland et al. ..... 345/90
5,903,246 A * 5/1999 Dingwall ..... 345/82
5,945,972 A * 8/1999 Okumura et al. ..... 345/98
6,169,532 B1 * 1/2001 Sumi et al. ..... 345/98

FOREIGN PATENT DOCUMENTS

| | | |
|---|---|---|
| JP | 56-117275 | 9/1981 |
| JP | 59-133586 | 7/1984 |
| JP | 60-41030 | 3/1985 |
| JP | 62-75516 | 4/1987 |
| JP | 62-172424 | 7/1987 |
| JP | 3-88022 | 4/1991 |
| JP | 6-102530 | 4/1994 |
| JP | 8-338978 | 12/1996 |
| JP | 9-258168 | 10/1997 |
| JP | 10-228012 | 8/1998 |

* cited by examiner

*Primary Examiner*—Richard Hjerpe
*Assistant Examiner*—Jean Lesperance
(74) *Attorney, Agent, or Firm*—McGinn & Gibb, PLLC

(57) ABSTRACT

A LED display panel has a plurality of pixel elements arranged in a matrix along a row direction and a column direction, wherein each of the pixel elements includes a LED and an associated memory cell for storing image data for the pixel. The memory cell functions for a video RAM generally disposed separately from the LED display panel in a conventional LED display panel. A higher-speed operation and reduction of occupied area can be obtained in the LED display panel of the present invention.

20 Claims, 2 Drawing Sheets

LED DISPLAY PANEL HAVING A MEMORY CELL FOR EACH PIXEL ELEMENT

BACKGROUND OF THE INVENTION (a) Field of the Invention

The present invention relates to a light emitting diode (LED) display panel having a memory cell for each pixel and, more particularly, to a LED display panel for use as a graphic display panel of a personal computer system.

(b) Description of the Related Art

A conventional graphic display panel of a personal computer system is generally provided with an associated VRAM. A graphic controller in the graphic display panel reads image data directly from the VRAM, converts the same to display data in a display format and writes the display data to each pixel element at a high speed, the image data being supplied from a processor of the computer system prior to the read operation by the graphic controller.

The graphic controller iteratively reads the image data from the VRAM to allow the display data in each pixel to coincide with a corresponding one of the latest image data supplied from the processor. This iterative read-out of the image data by the graphic controller reduces the work time of the controller for the graphic operation on the display panel, thereby reducing the speed of the graphics.

In addition, a sufficient standard is not provided for a flat display panel such as a LED display panel or a liquid crystal panel. The design for a graphic controller used for a display panel is generally changed depending on the design for the display panel, and accordingly, the cost of the graphic controller rises, which in turn raises the cost of the graphic display panel.

SUMMARY OF THE INVENTION

In view of the above, it is an object of the present invention to provide a LED display panel fabricated at a low cost, having a reduced occupied area and capable of operating at a higher speed.

The present invention provides a LED display panel comprising: a pixel array including a plurality of pixel elements arranged in a matrix along a row direction and a column direction, a plurality of word lines each disposed for a corresponding row of the pixel elements, and a bit line each disposed for a corresponding column of the pixel elements, each of the pixel elements having a LED and an associated memory cell,; an address port for receiving an address signal including a row address and a column address; a row address decoder for receiving the row address from the address port to specify one of the word lines; a column address decoder for receiving the column address from the address port to specify one of the bit lines; and a buffer for writing image data through the specified bit line to one of the memory cells corresponding to the specified word line, an output of the memory cell controlling the associated LED.

In accordance with the LED display panel of the present invention, a higher-speed operation, reduction in the occupied area and the fabrication cost can be obtained because a video RAM is not provided separately from the LED display panel and refreshment operation by a video controller of the LED display panel is not needed.

The above and other objects, features and advantages of the present invention will be more apparent from the following description, referring to the accompanying drawings.

PREFERRED EMBODIMENT OF THE INVENTION

Figure 1:
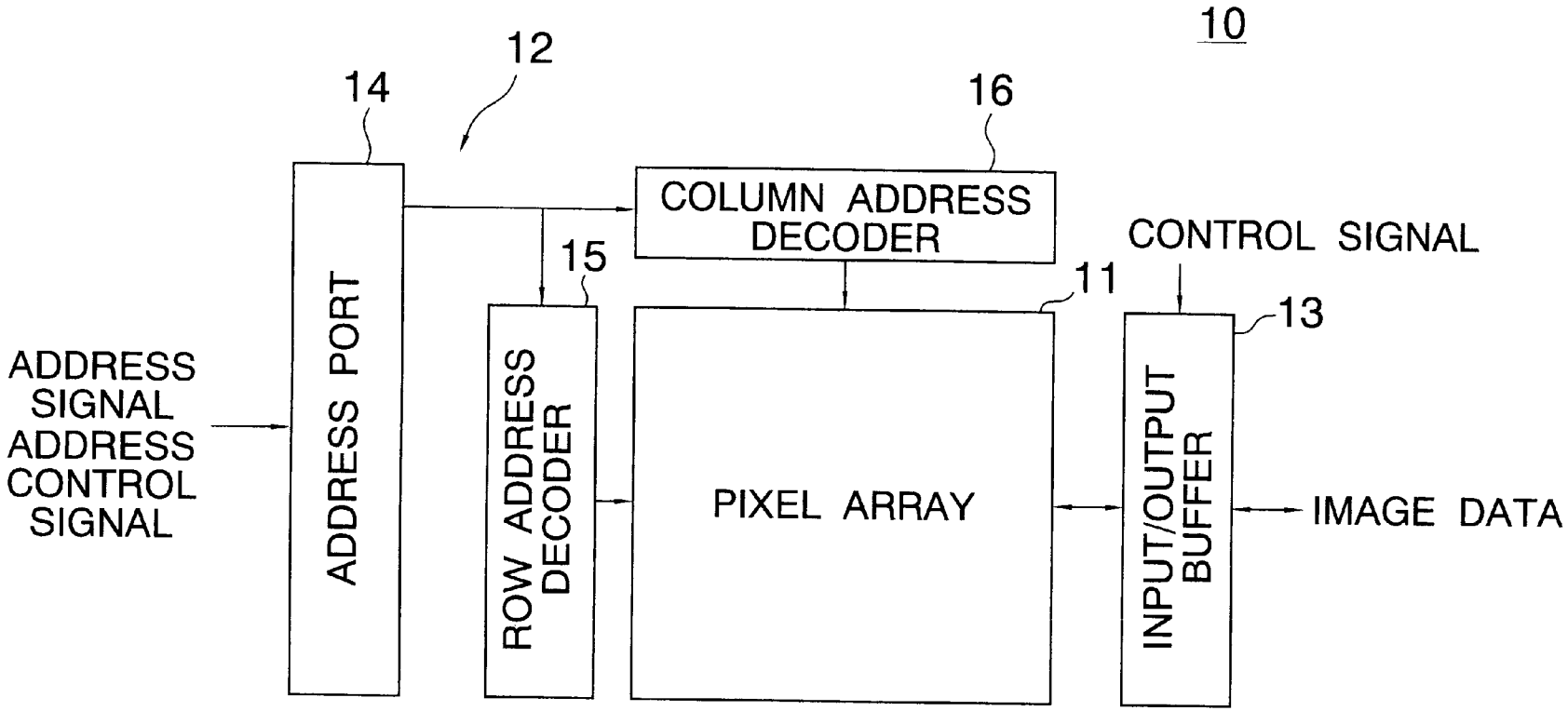
FIG. 1 is a block diagram of a LED display panel according to an embodiment of the present invention.

Referring to FIG. 1, a LED display panel according to an embodiment of the present invention has a display panel implemented by a pixel array 11 including an array of pixel elements for displaying image data on the display panel, a driver section 12 for controlling the array of the pixel elements, and an input/output buffer 13 for writing/reading data to/from the array of pixel elements.

Figure 2:
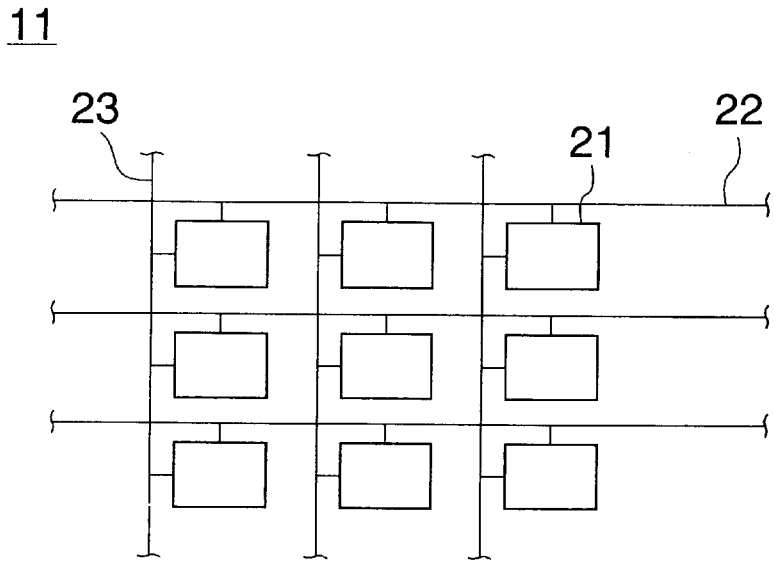
FIG. 2 is a block diagram of the arrangement of pixel elements of the LED display panel of FIG. 1.

Referring to FIG. 2, the LED display panel includes a plurality of (M×N) pixel elements 21 arranged in a matrix along a row (horizontal) direction and a column (vertical) direction, a plurality of (M) word lines 22 each corresponding to a row of the pixel elements 21, a plurality of (N) bit lines 23 each corresponding to a column of the pixel elements 21.

Back to FIG. 1, the driver section 12 includes an address port 14 for receiving address signals and address control signals, a row address decoder 15 for receiving row address signals of the address signals from the address port 14 to activate one of the word lines 22, a column decoder 16 for receiving the column address signals of the address signals to activate one of the bit lines 23.

The input/output buffer 13 receives a control signal for selecting a write mode or a read mode of the input buffer 13. The input/output buffer transmits an input image data from the processor to the pixel array 11 after conversion of the image data to display data in a display format during the write mode. The input/output buffer transmits display data from the pixel array 11 to the processor after conversion of the display data to image data in a computer format during the read mode. The read mode is generally used for storing the image data used for displaying the image in a data file.

Figure 3:
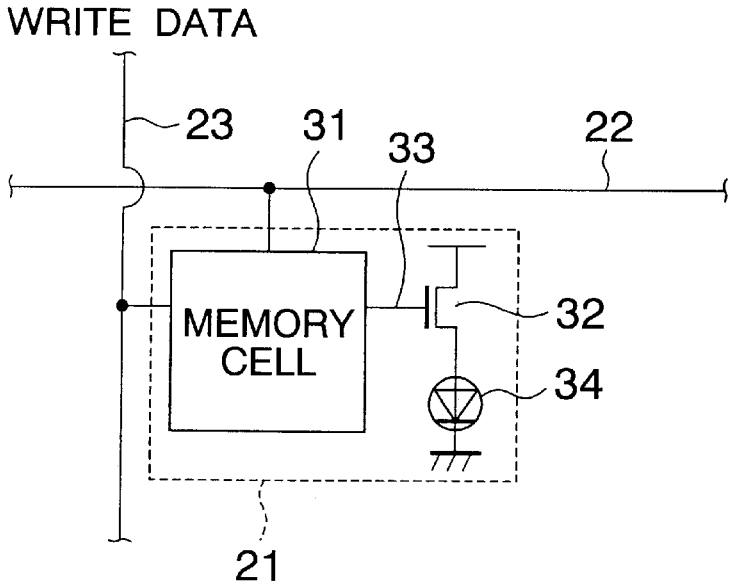
FIG. 3 is a block diagram of each pixel element shown in FIG. 2.

Referring to FIG. 3, each pixel element 21 has a memory cell 31 for storing display data therein, a MOS transistor 32 having a gate controlled by an output line 33 of the memory cell 31, and a LED 34 controlled by the MOS transistor 32 for emitting light based on the data stored in the memory cell 31. Each write data is supplied through a bit line 23, which is specified by a column address, to the memory cell 31 corresponding to the specified bit line 23 and a word line 22 selected by the row address. The memory cell 31 may be a DRAM cell, SRAM cell, FRAM (ferroelectric RAM) cell or PROM cell.

If a DRAM cell is used as the memory cell 31, a page write operation may be used, similarly to an ordinary DRAM, by consecutively selecting bit lines 23 while selecting a single word line 22. If a SRAM cell is used as the memory cell 31, the LED display panel operates at a higher speed. If a FRAM cell is used as the memory cell 31, the display data is maintained on the LED display panel after the LED display panel is switched off. This allows the display data on the display panel to be stored in a data file outside the display panel. If a PROM cell is used as the memory cell 31, the LED display panel is preferably used for advertisement, wherein the data stored in the PROM is changed or modified for adapting the display data to a new version of the advertisement. If the LED display panel of the embodiment is to be used for displaying color images, different LEDs are used in combination for displaying three primary colors in each spot.

In operation of the LED display panel, a processor delivers an ordinary VRAM address signal to the address port 14, which transfers a row address to the row address decoder 15 and a column address to the column address decoder 16, thereby selecting a word line 22 and a bit line 23 corresponding to a specified pixel element 21. Input write data is delivered through the input/output buffer 13 and the selected bit line 23 to the memory cell 31 of the specified pixel element 21, which stores the write data therein. If the input write data is "1", the memory cell 31 activates the MOS transistor 32 to allow the corresponding LED 34 to emit light. If the write data is "0", the memory cell 31 inactivates the MOS transistor 32 to allow the corresponding LED 34 to turn off. A read operation from the LED display panel is conducted by specifying a pixel element 21, similarly to the write operation, and controlling the input/output buffer 13 to operate in a read mode by selecting a read mode.

In the above embodiment, refreshment of display data in each pixel element 21 is not necessary because each LED 34 is associated with a corresponding memory cell 31 storing display data in the pixel element 21. In addition, since the LED display panel has a VRAM function and a display function in each pixel element 21, the video controller and the address decoder in the conventional LED display panel can be unified. Further, the LED display panel of the present embodiment can operate at a higher speed.

Since the above embodiment is described only for examples, the present invention is not limited to the above embodiment and various modifications or alterations can be easily made therefrom by those skilled in the art without departing from the scope of the present invention.

What is claimed is:

1. A display panel comprising:

a pixel array comprising:

a plurality of pixel elements arranged in a matrix along a row direction and a column direction, each said pixel element comprising:

a light emitting device;

a memory cell which is associated with said light emitting device and physically disposed within said pixel element; and a metal oxide semiconductor (MOS) transistor having a gate which receives data from said memory cell and activates and deactivates said light emitting device based on said data;

a plurality of word lines each disposed for a corresponding row of said pixel elements; and a plurality of bit lines each disposed for a corresponding column of said pixel elements;

an address port for receiving an address signal including a row address and a column address;

a row address decoder for receiving said row address from said address port of specify one of said word lines;

a column address decoder for receiving said column address from said address port to specify one of said bit lines; and an input/output buffer having a write mode for writing data through said specified bit line to one of said memory cells corresponding to said specified word line, and a read mode for reading data from said memory cell controlling an associated one of said light emitting devices, said buffer transmitting display data from said pixel array to a processor during said read mode.

2. The display panel as defined in claim 1, wherein said buffer reads data from a specified memory cell through a corresponding one of said bit lines.

3. The display panel as defined in claim 1, wherein each said light emitting device emits light comprising one of three primary colors.

4. The display panel as defined in claim 1, wherein said memory cell comprises one of a DRAM cell, an SRAM cell, a FRAM cell, and a PROM cell.

5. The display panel as defined in claim 1, wherein said light emitting device comprises at least one of a red light emitting diode, green light emitting diode and blue light emitting diode.

6. The display panel as defined in claim 1, wherein each said pixel element is associated with a memory cell storing display data such that refreshment of said display data is unnecessary.

7. The display as defined in claim 1, wherein each said pixel element comprises a video random access memory (VRAM) function and a display function such that a VRAM separate from said display panel is unnecessary.

8. The display panel as defined in claim 1, wherein each said pixel element comprises a video random access memory (VRAM) function and a display function so that a video controller function and an address decoder function are unified.

9. The display panel as defined in claim 1, wherein said data comprises image data, and said buffer receives said image data from a processor, converts said image data to display data, and transmits said display data to said pixel array.

10. The display panel as defined in claim 1, wherein said buffer receives display data from said pixel array, converts said display data to image data, and transmits said image data to a processor.

11. The display panel as defined in claim 1, wherein said memory cell comprises a dynamic random access memory (DRAM) cell so that bit lines may be consecutively selected while selecting a single word line.

12. The display panel as defined in claim 1, wherein said memory cell comprises a ferroelectric random access memory (FRAM), and wherein display data is maintained on said display panel after said display panel is switched off.

13. The display panel as defined in claim 1, wherein said memory cell comprises a programmable read only memory (PROM), and wherein said display panel displays advertising data.

14. The display panel as defined in claim 1, wherein if said write data is "1" said memory cell activates said MOS transistor.

15. The display panel as defined in claim 1, wherein if said write data is "0" said memory cell deactivates said MOS transistor.

16. A display panel comprising:

a pixel array comprising a plurality of bit lines, a plurality of word lines, and a plurality of pixel elements, each said pixel element comprising:

a light emitting device;

a memory cell associated with said light emitting device and physically disposed within said pixel element; and a metal oxide semiconductor (MOS) transistor having a gate which receives data from said memory cell and activates and deactivates said light emitting device based on said data;

an address port for receiving an address signal including a row address and a column address;

a row address decoder for receiving said row address from said address port of specify one of said word lines;

a column address decoder for receiving said column address from said address port to specify one of said bit lines; and an input/output buffer having a write mode for writing data through a specified bit line to said memory cell corresponding to a specified word line, and a read mode for reading data from said memory cell, said buffer transmitting display data from said pixel array to a processor during said read mode.

17. The display panel according to claim 16, wherein said read mode is used to store image data used to display an image in a data file.

18. The display panel according to claim 16, wherein a read operation is performed by specifying a pixel element and controlling said buffer to operate in a read mode.

19. A display panel comprising:

a pixel array comprising a plurality of bit lines, a plurality of word lines, and a plurality of pixel elements, each said pixel element comprising:

a light emitting device;

a memory cell associated with said light emitting device and physically disposed within said pixel element; and a metal oxide semiconductor (MOS) transistor having a gate which receives data from said memory cell and activates and deactivates said light emitting device based on said data; and an input/output buffer having a write mode for writing data through a specified bit line to said memory cell corresponding to a specified word line, and a read mode for reading data from said memory cell, said buffer transmitting display data from said pixel array to a processor during said read mode.

20. The display panel according to claim 1, wherein said input/output buffer is directly coupled to said pixel array.

* * * * *